United States Patent [19]

Altenaü et al.

[11] 4,305,333

[45] Dec. 15, 1981

[54] WARHEAD FOR PROJECTILES AND ROCKETS

[75] Inventors: Ernst-Wilhelm Altenaü, Duisburg; Wolfram Witt, Duesseldorf, both of Fed. Rep. of Germany

[73] Assignee: Rheinmetall GmbH, Duesseldorf, Fed. Rep. of Germany

[21] Appl. No.: 65,620

[22] Filed: Aug. 10, 1979

[30] Foreign Application Priority Data

Aug. 14, 1978 [DE] Fed. Rep. of Germany ..... 2835557

[51] Int. Cl.[3] ..... F42B 13/12

[52] U.S. Cl. ..... 102/306; 102/493

[58] Field of Search ..... 102/24 HC, 56 SC, 67, 102/68

[56] References Cited

U.S. PATENT DOCUMENTS

| | | | |
|---|---|---|---|
| 3,000,309 | 9/1961 | Zapf | 102/67 |
| 3,263,612 | 8/1966 | Throner, Jr. | 102/68 X |
| 3,298,308 | 1/1967 | Throner, Jr. | 102/67 |
| 3,491,694 | 1/1970 | Fountain | 102/67 |
| 3,667,390 | 6/1972 | Medin et al. | 102/24 HC X |
| 3,974,771 | 8/1976 | Thomanek | 102/24 HC X |
| 4,072,107 | 2/1978 | Saxe et al. | 102/56 SC X |

FOREIGN PATENT DOCUMENTS

| | | | |
|---|---|---|---|
| 1946990 | 3/1971 | Fed. Rep. of Germany | 102/56 SC |
| 973780 | 10/1948 | France | 102/56 SC |
| 1593370 | 11/1968 | France | 102/56 SC |
| 2116781 | 6/1972 | France | 102/24 HC |

*Primary Examiner*—Peter A. Nelson

[57] ABSTRACT

Warhead for projectiles and rockets in which the projectile or rocket casing can be relied upon to decompose into splinters of predetermined size, shape, and distribution. To accomplish this result, a thin-walled insert is positioned between the projectile or rocket casing and the explosive charge, such insert being provided with a number of ribs forming a series of saddle-roof shaped structures which exert a cutting charge effect on the casing on the detonation of the explosive charge.

9 Claims, 6 Drawing Figures

WARHEAD FOR PROJECTILES AND ROCKETS

The invention relates to a warhead for projectiles and rockets in which the explosive, which rests against the internal wall of the projectile casing, is inserted and secured thereto in form of a pressed body.

Ger. Pat. No. 322,079 discloses a projectile with inserts which rest concentrically against the internal wall of the projectile, such inserts which decompose on the detonation of the projectile, being provided with wedge-shaped projections. These inserts which are also provided with internal notches, consist of cast steel and serve to reinforce the comparatively thin-walled casing and for the defined formation of splinters. In order to increase the splintering effect, the projectile disclosed in said patent also provides that an insert, likewise having wedge-shaped projections, is to be inserted into the original insert in such a way that the wedge-shaped projections of the respective inserts engage one another. The hollow space left in the projectile for the explosive charge can thus be made cylindrical, with smooth walls. The expression "projectile casing" used in this connection is not limited to projectiles, but also applies to warheads of rockets and the like, insofar as they have explosive compositions enclosed in a splinter-forming casing.

An explosive projectile according to Brit. Pat. No. 1,142,716 is constructed in a similar fashion, the internal surface of its projectile casing being provided with right-handed keyways taking a helical course. A casing of which the exterior has left-handed keyways taking a helical course rests against the aforementioned internal surface. It is true that, by those surfaces of the projectile casing which rest against one another and are provided with keyways, numerous zones are provided in which the keyways overlap, but it is doubtful whether this can ensure the optimumly satisfactory formation of splinters, since the fields, of course, are formed not by the keyways of one single projectile body but by these of two projectile bodies resting one on the other.

The purpose of the invention is to provide a warhead which is provided with an explosive or hollow charge and in which the projectile casing can be relied upon to decompose into splinters of predetermined shape, size and distribution.

The invention enables this object to be achieved by a thin-walled insert which is positioned between the projectile casing and the explosive charge and which is provided with a number of ribs forming a series of saddle-roof-shaped structures and exerting a cutting charge effect on the projectile casing on the detonation of the explosive charge.

A further characteristic of the invention resides in the fact that the insert, which wholly or partly lines the projectile casing, consists of a thin-walled casing of sheet metal or plastic material. The invention provides that the ribs can be so arranged that by grooves taking an axial, radial, or spiral course in the insert they form a cohesive grid network. It is also possible, however, for the ribs to be positioned paraxially and chessboard-wise in the insert, the distance between the ribs of adjacent rows being such that upon the detonation of the projectile, it can be bridged by the formation of an additional crack in the projectile casing.

In a warhead in which that internal surface of the projectile casing is subdivided by keyways into a multiplicity of small fields, the invention provides that the insert is associated with each keyway in the projectile casing, the ribs presenting in conjunction with one another a rhomboidal cross section of which the longitudinal diagonal takes its course radially to the axis of the projectile.

It is also possible, however, for the projectile casing and/or the insert to be subdivided into small fields by means of grooves or ribs of circular or elliptical cross section.

Finally, the invention provides that, in the case of a warhead with a hollow charge on the side corresponding to the head, the grooves or ribs are situated to the side of the hollow charge.

The invention will be explained in greater detail by reference to the accompanying drawings and on the basis of certain preferred examples.

IN THE DRAWINGS

Figure 1:
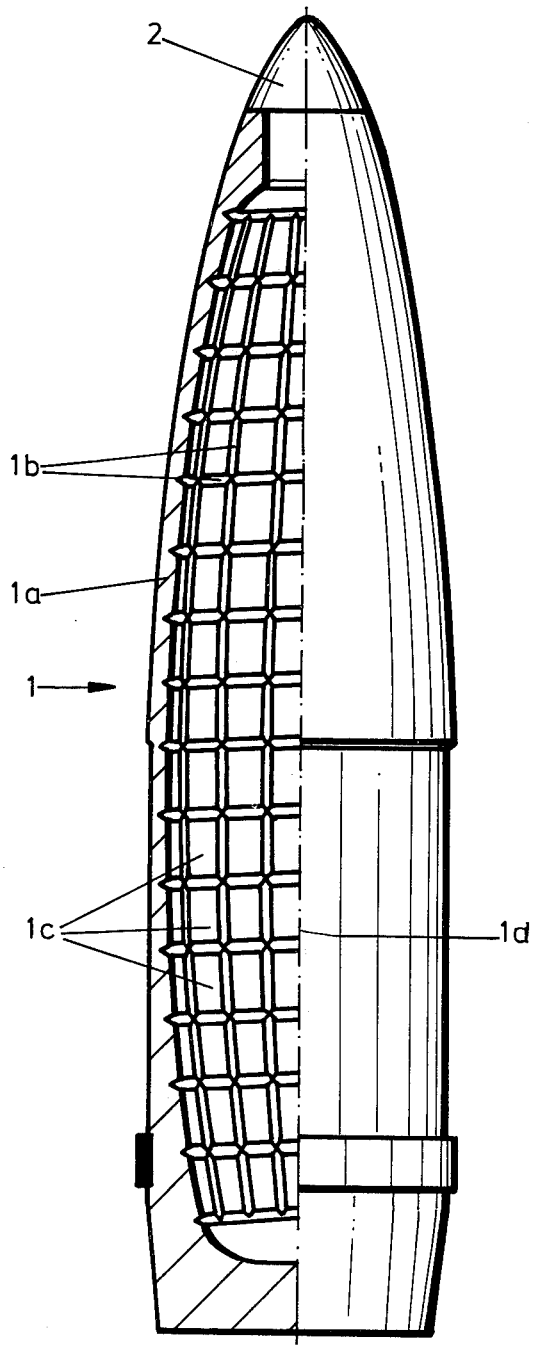
FIG. 1 is a view of an explosive projectile, partly in side elevation and partly in longitudinal section, the inner projectile casing surface being subdivided into a multiplicity of fields.
Figure 2:
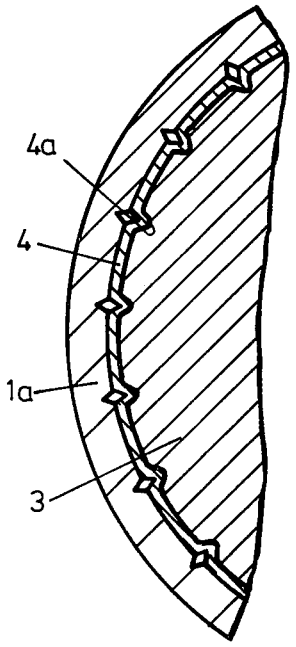
FIG. 2 is a view in transverse section of a portion of the explosive projectile shown in FIG. 1 on a larger scale.

Turning first to FIGS. 1 and 2, explosive projectile 1, which is provided with a head detonator 2 and with detonation transmission charges, not shown in the drawing, for the cast-in explosive charge 3, is provided on the internal surface of its projectile casing 1*a* with longitudinal and transverse keyways or grooves 1*b* which enclose between them a multiplicity of largely quadratic or polygonal fields 1*c*. The keyways 1*b* in section preferably form acute-angled triangles of which the axes of symmetry are all directed towards the longitudinal axis 1*d* of the projectile.

A thin-walled metallic insert 4 (FIG. 2), having ribs 4*a* pointed inwards towards the axis 1*d* of the projectile, rests against the internal surface of the said projectile 1*a*. The ribs 4*a* are so arranged that they are situated exactly opposite the keyways 1*b*, the said keyways 1*b* and ribs 4*a* having a rhomboidal shape of which the longitudinal diagonal is directed towards the longitudinal axis 1*d* of the projectile.

Figure 3:
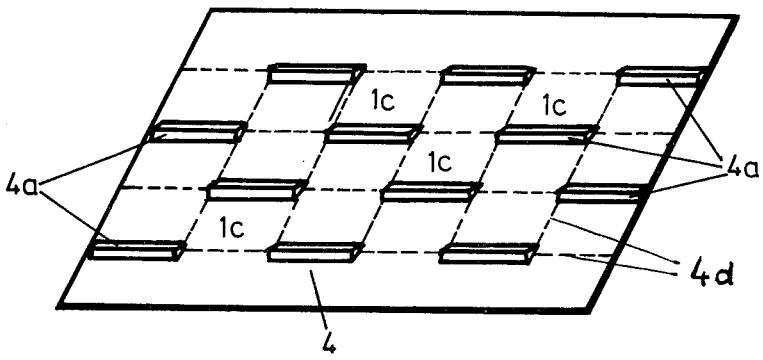
FIG. 3 is a fragmentary view in perspective of an insert made of plastic foil and having ribs arranged paraxially and chessboard-wise.

FIG. 3 shows an insert 4 of flat design, made of plastic and having paraxial ribs 4*a* arranged chessboard-wise. With comparatively thin-walled projectile casings 1*a* it may be of advantage, from the point of view of the firing resistance of the projectile casing 1*a*, if it is not weakened in cross section by grooves or keyways but is smooth-walled inside and outside. The roof-shaped ribs 4*a* of the insert 4 form channel-shaped linings which are in the nature of a cutting charge.

Figure 4:
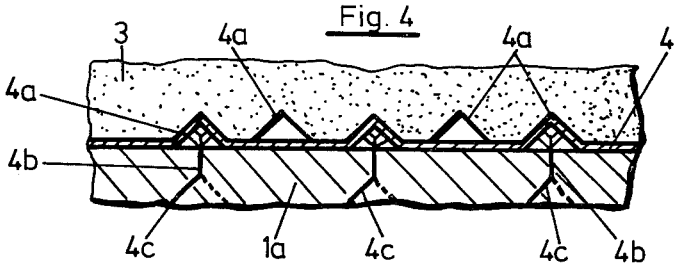
FIG. 4 is a view in cross section through an internally smooth projectile casing, in conjunction with a metallic insert consisting of roof-shaped ribs.
Figure 5:
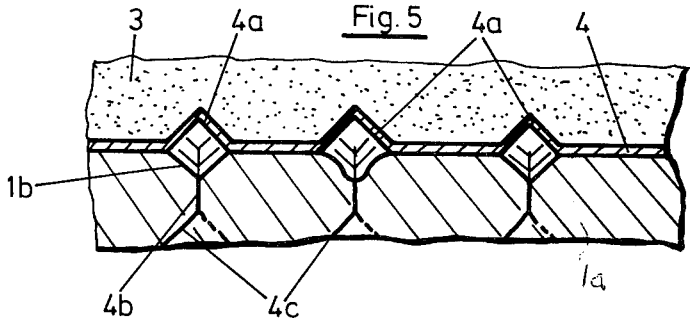
FIG. 5 is a view in cross section through a projectile casing of which the interior is provided with keyways and opposite which there is provided a metallic insert with ribs.

In the examples shown in FIGS. 2, 4 and 5, with a metallic insert 4 consisting of roof-shaped ribs 4*a*, the cutting charge effect is due to the fact that on the detonation the energy of the explosive substance is transformed into kinetic energy by the metal insert, this latter being accelerated in radial directions at a speed exceeding the explosion velocity of the said explosive substance. This, however, means that on the detonation of the explosive charge 3 the cutting jets formed by the ribs 4*a* makes impact on the base of the keyways 1*b* in the radial direction, after which, in the same direction, it penetrates the projectile casing 1*a*, fracturing it at points of which one is marked 4*b* (FIGS. 4 and 5).

As a result of the pressure wave which accompanies this motion, the force of which exceeds the strength of the material of which the projectile casing 1*a* is made, the said projectile casing 1*a* undergoes a number of shear fractures 4*c* which extend from the cracks 4*b* to the outside at an angle of about 45°. This ensures the decomposition of the projectile casing 1*a* into splinters of predetermined size and shape.

In the case of explosive projectiles with comparatively thin-walled casings 1*a* it may be necessary, in order not to jeopardize the firing resistance of the projectile, to dispense with keyways 1*b* in the projectile casing 1*a*.

FIG. 4 shows an example of this kind, the cutting charge effect being obtained just as reliably by the cutting jet, even if the latter is not quite so effective as in the case of a projectile casing 1*a* weakened by keyways 1*b*. Tests have shown that a noticeable cutting charge effect is also obtained if, in place of a metallic insert 4 provided with ribs 4*a*, an insert 4 made of a plastic foil is used, as shown in FIG. 3. The said foil can preferably be rendered plasticizable by heating and then shaped in such a way as to form ribs 4*a* taking a paraxial direction and arranged chessboard-wise. One very simple method of achieving this object is to line a subdivided mold with a foil, at the time when the explosive body 3 is being manufactured, after which the explosive substance is filled into it, the mold provided with the projections producing the ribs 4*a* being closed after the foil has been sufficiently heated.

The plastic foil serving as an insert 4 encloses the explosive body 3, in which process all the ribs 4 together with the corresponding channel for the explosive substance are finished when the cooled explosive body 3 is extracted from the open mold.

Furthermore, the distances between the ribs 4*a* in adjacent rows are selected to ensure that on the detonation of the explosive charge 3 they will be bridged by the formation of an additional crack 4*d* (FIG. 3). This means, however, that as a result of the cutting charge effect and the formation of the crack 4*d* the projectile casing 1*a* is entirely subdivided into square fields 1*c*, so that the desired decomposition of the projectile casing 1*a* into splinters of predetermined size and shape is once again ensured.

Figure 6:
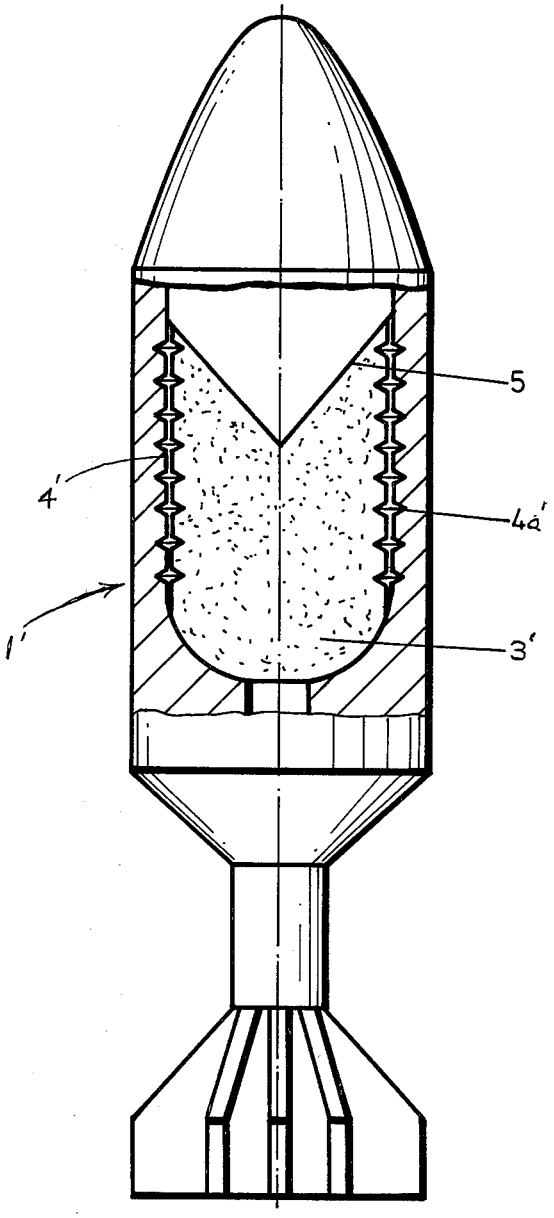
FIG. 6 is a view of a projectile partly in elevation and partly in section and with ribs or grooves positioned to the side of the hollow charge.

In FIG. 6 there is shown an explosive projectile 1' having a hollow charge 5 at the head, the explosive charge 3', of which is encased in an insert 4' provided with ribs 4*a'*. Needless to say, if the thickness of the projectile casing 1*a'* allows, this latter can be provided with the internal keyways such as 1*b*. If a projectile of this kind hits an armored vehicle, for instance, not only the vehicle itself and possibly its crew will be hit by the hollow charge, but also the troops preceding it in order to protect it will be hit, owing to the complete decomposition of the projectile casing into splinters of predetermined size, shapes, and distribution. Furthermore, these warheads are also suitable for attack on living targets, since the hollow charge projectiles normally having a moderate fragmentation effect can be used more universally and effectively in conjunction with the cutting charge effect.

Needless to say, it is also possible, within the scope of the invention, to apply the cutting charge effect for optimum fragmentation for other purposes.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A warhead for a projectile or rocket, comprising an outer casing, a thin-walled inserted lining in at least a part of the casing, and an explosive charge within the casing inwardly of the lining, the insert being provided with a number of ribs forming a series of saddle-roof-shaped rib structures which exert a cutting charge effect on the projectile casing on the detonation of the explosive charge, and wherein the internal surface of the projectile casing which rests against the explosive charge is subdivided into a number of small fields defined by grooves therein, each rib-structure in the lining being associated with each groove in the casing, the rib-structures and grooves presenting in conjunction with one another a rhomboidal cross section of which the longitudinal diagonal is directed radially of the axis of the casing.

2. A warhead in accordance with claim 1, wherein the explosive charge intimately engages the inner surface of the lining.

3. A warhead in accordance with claim 2, wherein the explosive charge is cast into the lining.

4. A warhead in accordance with claim 1, wherein the lining consists of sheet material.

5. A warhead in accordance with claim 1, wherein the rib structures include grooves in the lining which form a cohesive grid network.

6. A warhead in accordance with claim 1, wherein the rib structures are positioned paraxially and chessboard-wise in the insert, the distance between the rib structures of adjacent rows being such that on the detonation of the explosive charge the rupture of rib structures leads to the formation of additional cracks in the projectile casing.

7. A warhead in accordance with claim 1, wherein at least a portion of the casing and a portion of the insert is subdivided into small fields by means of grooves or rib structures of arcuate triangular cross section.

8. A warhead in accordance with claim 1, wherein the rib structures of the insert rest against a smooth-walled internal surface of the casing.

9. A warhead in accordance with claim 8, wherein the explosive charge has a hollow therein facing the forward end of the casing.

* * * * *